US005256003A

United States Patent [19]

Ito et al.

[11] Patent Number: 5,256,003

[45] Date of Patent: Oct. 26, 1993

[54] METHOD FOR AUTOMATICALLY DRIVING GRAVEL DRAIN PILES AND EXECUTION APPARATUS THEREFOR

[75] Inventors: Katsuhiko Ito, Hunabashi; Rentaro Ikeda, Omiya; Tadao Koike, Konosu; Yutaka Nakajima, Kawasaki; Yasuharu Okita, Mino; Haruo Ichikawa, Yachiyo, all of Japan

[73] Assignees: Konoike Construction Co., Ltd., Osaka; NKK Corporation, Tokyo, both of Japan

[21] Appl. No.: 895,425

[22] Filed: Jun. 5, 1992

Related U.S. Application Data

[63] Continuation of Ser. No. 632,529, Dec. 24, 1990, abandoned.

[30] Foreign Application Priority Data

Dec. 26, 1989 [JP] Japan ..... 1-337056

[51] Int. Cl.[5] ..... E02D 3/10; E02D 3/08

[52] U.S. Cl. ..... 405/232; 405/50

[58] Field of Search ..... 405/50, 232, 233, 240, 405/243, 249, 257; 73/84

[56] References Cited

U.S. PATENT DOCUMENTS

| | | | |
|---|---|---|---|
| 2,656,684 | 10/1953 | Rios et al. | 405/243 X |
| 3,960,008 | 6/1976 | Goble et al. | 73/84 |
| 4,730,954 | 3/1988 | Sliwinski et al. | 405/240 |

FOREIGN PATENT DOCUMENTS

| | | | |
|---|---|---|---|
| 971834 | 3/1959 | Fed. Rep. of Germany | 405/240 |
| 2260473 | 6/1974 | Fed. Rep. of Germany | 405/232 |
| 185819 | 10/1983 | Japan | 405/232 |
| 189408 | 11/1983 | Japan | 405/232 |
| 55113 | 3/1985 | Japan | 405/232 |
| 31171 | 11/1933 | Netherlands | 405/233 |
| 903473 | 2/1982 | U.S.S.R. | 405/233 |

*Primary Examiner*—Dennis L. Taylor
*Assistant Examiner*—John Ricci
*Attorney, Agent, or Firm*—Oblon, Spivak, McClelland, Maier & Neustadt

[57] ABSTRACT

A method comprising interpenetrating a hollow casing into a relatively loose sand layer saturated with ground water, thereafter raising the casing while tamping crushed stones charged into the casing by a compaction rod disposed within the casing, and driving gravel drain piles while continuously performing the raising of the casing and the tamping of the crushed stones. After the casing has reached the predetermined depth and the charging of crushed stones has been confirmed an, amplitude of reaction is detected by a reaction detection device provided on the compaction rod or a load current measuring device of the compaction rod. The reaction value is compared with a set reaction value, and one or more factors (a raising speed of the casing, a period, an amplitude and an extreme end surface-height of the compaction rod for determining a compacting degree of a peripheral ground) are controlled in response to the compared value.

10 Claims, 8 Drawing Sheets

(a)

(b)

METHOD FOR AUTOMATICALLY DRIVING GRAVEL DRAIN PILES AND EXECUTION APPARATUS THEREFOR

This application is a continuation of application Ser. No. 07/632,529, filed on Dec. 24, 1990, now abandoned.

BACKGROUND OF THE INVENTION

1. Field of the Invention

This invention relates to a pile, that is, a so-called gravel drain pile comprising aggregates such as crushed stones, slag, gravel or cobbles, etc. having permeability and bearing capacity placed on a relatively loose sand foundation saturated with ground water, and more specifically to a method for automatically driving a gravel drain pile and an execution apparatus for carrying out the method which compacts the foundation in the periphery of the piles during the process of driving the gravel drain piles.

2. Description of the Prior Art

The present applicants have previously proposed the invention of a method for driving a gravel drain pile of this kind and an execution apparatus therefor in Japanese Patent No. 1,432,555 (Patent Publication No. 62(1987)-40,482, hereinafter referred to as "prior art").

That is, the method for driving a gravel drain pile according to the aforesaid invention is characterized by interpenetrating a hollow casing, an extreme end of which is closed, into predetermined depth, thereafter charging aggregates for driving a gravel drain pile into the casing and releasing the aggregates out of the extreme end of the casing, placing a compaction rod at a compacting position adjusted to the soil of the peripheral foundation and the grain size of aggregates, said compaction rod being disposed within the casing, transmitting impact force to the charged aggregates to compact the aggregates, and continuously performing the charging of the aggregates and the compacting with the compaction rod.

The driving apparatus according to the aforesaid invention comprises a hollow casing having an open- and closable lid at the extreme end thereof; a compaction rod which has a substantially equi-section, has a small diameter and is lengthy, said compaction rod being inserted from the lower end to the upper portion of the casing along a center axis within the casing; an impact drive device for a compaction rod disposed upwardly of the casing and being operatively connected to the compaction rod to transmit impact force to the compaction rod; and rod-height adjusting device for variably adjusting movement of an extreme end surface of the compaction rod.

That is, the invention according to prior art has aimed at compacting action by the compaction rod on crushed stones to achieve driving an effective gravel drain pile.

The aforesaid prior art has already proposed (1) the compaction of the peripheral ground by tamping during the driving process of the gravel drain pile can be expected, and (2) the gravel drain pile is driven while controlling decision factors of a tamping degree such as a raising speed of a hollow pipe, i.e., a casing, a period and amplitude of the compaction rod and a height of the extreme end surface thereof or a charging amount of crushed stones in accordance with the tamping degree determined while adjusting to the peripheral soil and the grain size of aggregates.

However, in the existing circumstances, it is not easy to control these factors, and such control greatly depends upon operators' experiences or intuitions. Therefore, it is also difficult to compact the peripheral foundation to the degree as desired.

The strength of the compacted ground is merely judged by a sounding test after a gravel drain pile has been driven. Even though the peripheral ground around the pile was not compacted enough to get higher strength, the pile can not be re-driven and it is left as it is. Therefore, the former method has a problem on quality control of ground compaction and becomes the bottleneck in raising efficiency of pile driving.

SUMMARY OF THE INVENTION

According to a new method for driving a gravel drain pile automatically and an execution apparatus therefore, the invention of prior art is further developed and the aforementioned problems have been overcome. It is an object of the present invention to improve the whole ground composed of gravel drain piles and a peripheral ground to the property as desired.

According to the present invention, there is provided a method for driving a gravel drain pile automatically, the method comprising interpenetrating a hollow casing into a relatively loose sand layer saturated with ground water till its predetermined depth keeping a spacing, thereafter raising the casing while tamping crushed stones charged into the casing by a compaction rod disposed within the casing, and driving a gravel drain pile in the sand layer while continuing raising of the casing and tamping the crushed stones by the compaction rod, characterized by detecting the magnitude of reaction by a reaction detecting device provided on the compaction rod or a load current measuring device of the compaction rod after the casing reaches the predetermined depth and charging of the crushed stones has been confirmed, comparing said reaction value with a set reaction value, and controlling one or plural factors (a raising speed of the casing, a period and amplitude of the compaction rod or height of extreme end thereof) for determining a compacting degree of peripheral ground on the basis of said compared value.

Further, an apparatus for driving a gravel drain pile automatically according to the present invention comprises a casing raising device for raising a hollow casing guided vertically movably along the leader and varying a raising speed of said casing; a drive device for a compaction rod for vertically moving a compaction rod disposed within said casing and varying a period and amplitude of the vertical movement of said compaction rod; a rod height adjusting device for vertically movably supporting said drive device or a compaction rod to vary an entered position of said compaction rod into said hollow casing; a compaction rod reaction detecting device disposed in the midst of said compaction rod to detect reaction of said compaction rod; a crushed stone top-end detecting device for detecting depth of a top end of crushed stones charged into the casing; and a casing depth detecting device for detecting an interpenetrated depth of the casing, characterized by the provision of a processing device wherein after said casing has reached predetermined depth and charging of crushed stones has been confirmed by said crushed stone top-end detecting device and said casing depth detecting device, a detected value from said compaction rod reaction detecting device is compared with a set reaction value, and one or plural factors (raising speed of casing, a period and amplitude of compaction rod or height of extreme end surface thereof) for determining a compacting degree of a peripheral ground are controlled through said casing raising device, said drive device for a compaction rod and said rod height adjusting device.

The grain size of the crushed stones is selected according to the situation of the soil of ground, and set values of tamping reaction according to a compacting degree of a predetermined peripheral ground calculated from the situation of the soil and the grain size of crushed stones are inputted as an upper limit value, a lower limit value or a representative value.

In the operation of the apparatus for driving a gravel drain pile, the reaction of the compaction rod driven up and down detects a tamping degree of a gravel drain pile without delay time, at a so-called real time.

The compacted ground having strength as desired is made within the range of the set value under the comparison of the set value on the basis of the detected value.

Accordingly, according to the present invention, (1) According to the method for driving a gravel drain pile automatically, properties of ground are grasped at real time by the reaction value of the compaction rod to improve the ground to a ground having a compacting degree as desired. Therefore, execution having reliability is realized. A sounding test need not be carried out after execution as in prior art, and efficient execution can be made. Furthermore, a wide spacing between drain piles in cooperation with a compacted ground can be secured to considerably reduced expenses of works.

(2) According to the apparatus for driving gravel drain pile automatically of the present invention, it is possible to place drain piles in a manner such that a ground in the periphery of the drain piles may be compacted to a value as desired without reliance on the skill of mechanical operation of an operator in correspondence to the state of ground which variously varies in terms of place (in terms of plane and depth) by using an execution apparatus for automatically controlling a reaction value of the compaction rod. Therefore, reliability after execution is enhanced and reduction in execution cost can also be attained.

DESCRIPTION OF THE PREFERRED EMBODIMENTS

Figure 1:
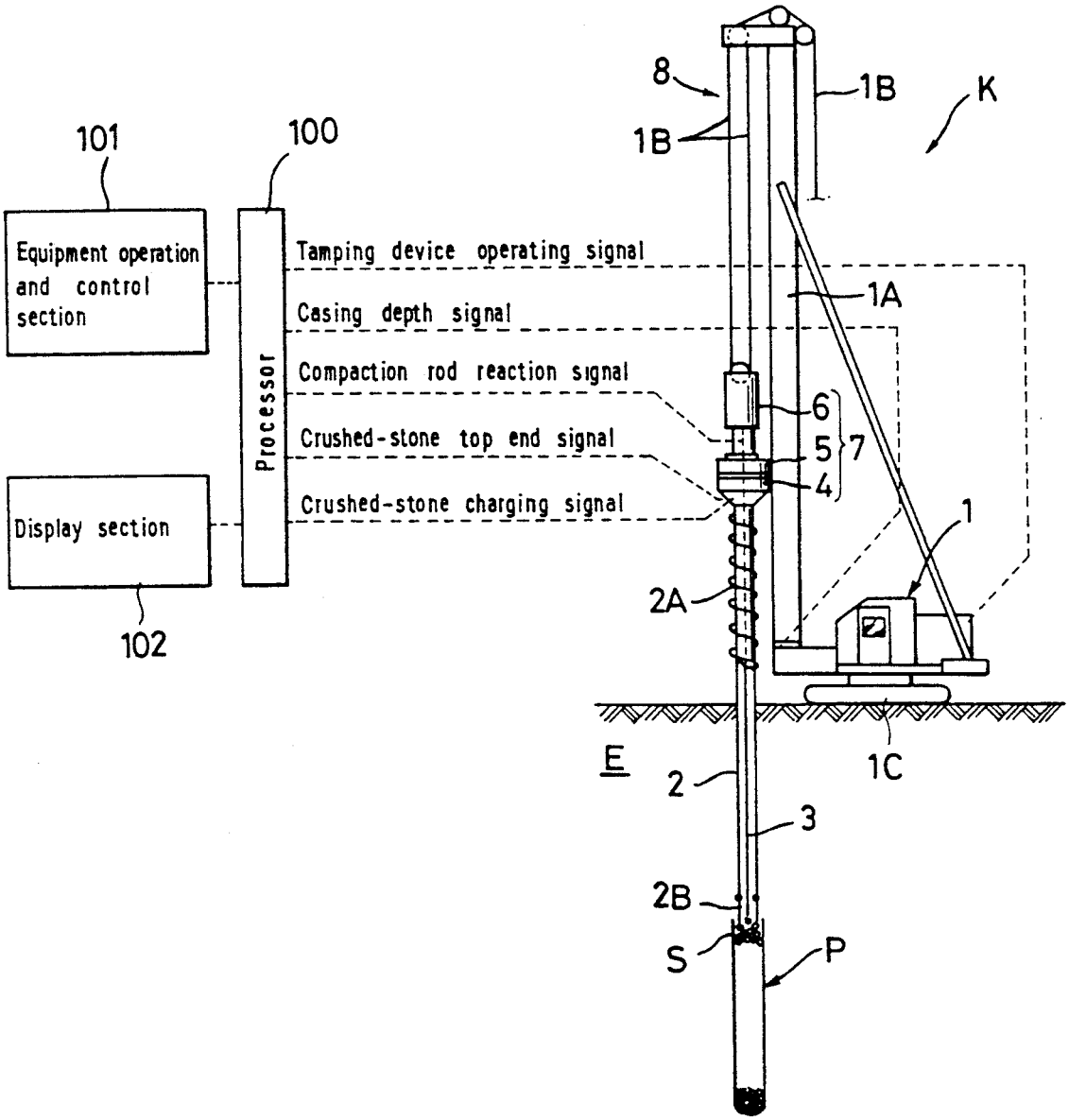
FIG. 1 is a schematic view of the whole apparatus according to one embodiment of the present invention.
Figure 2:
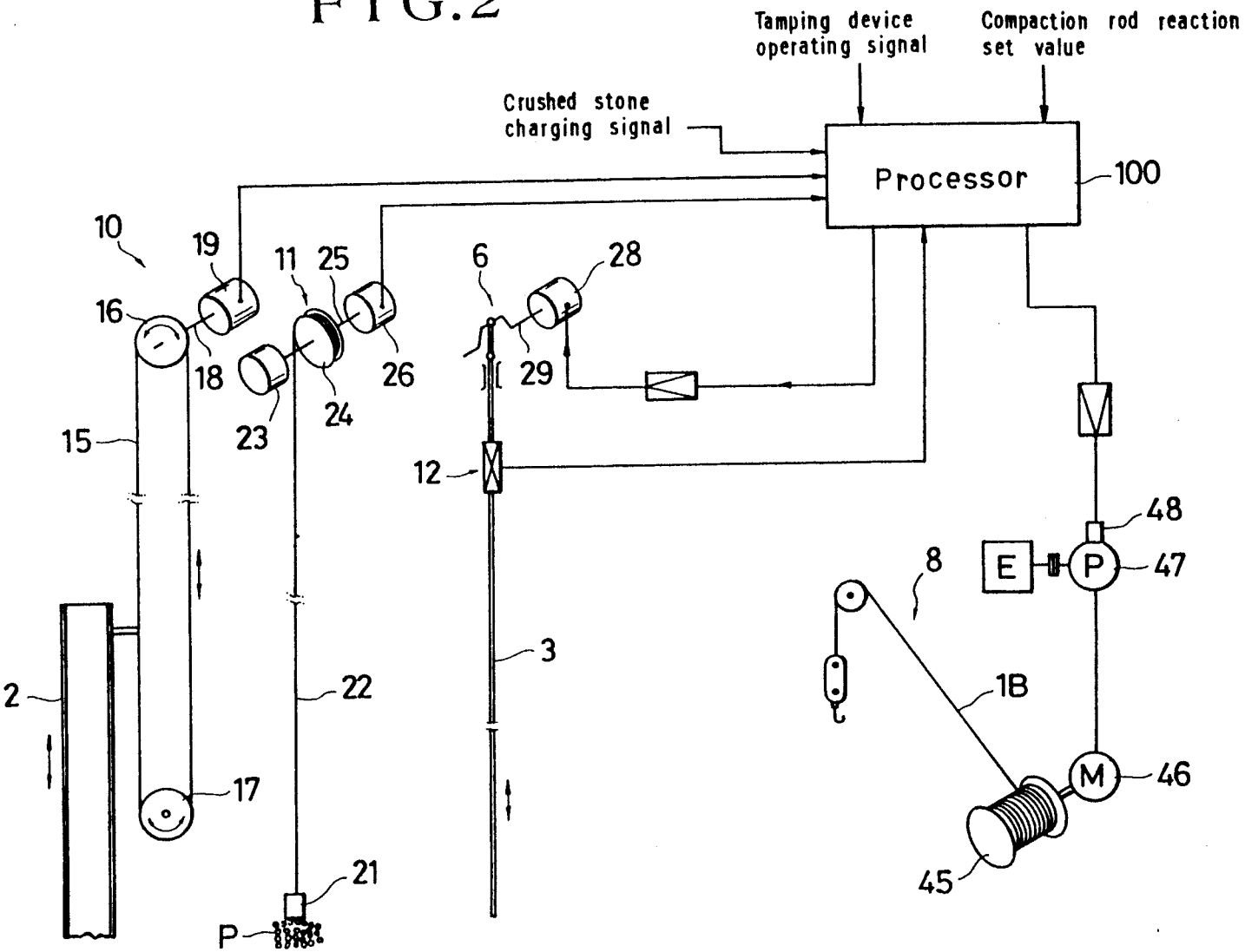
FIG. 2 is a schematic structural view of the whole apparatus.
Figure 3:
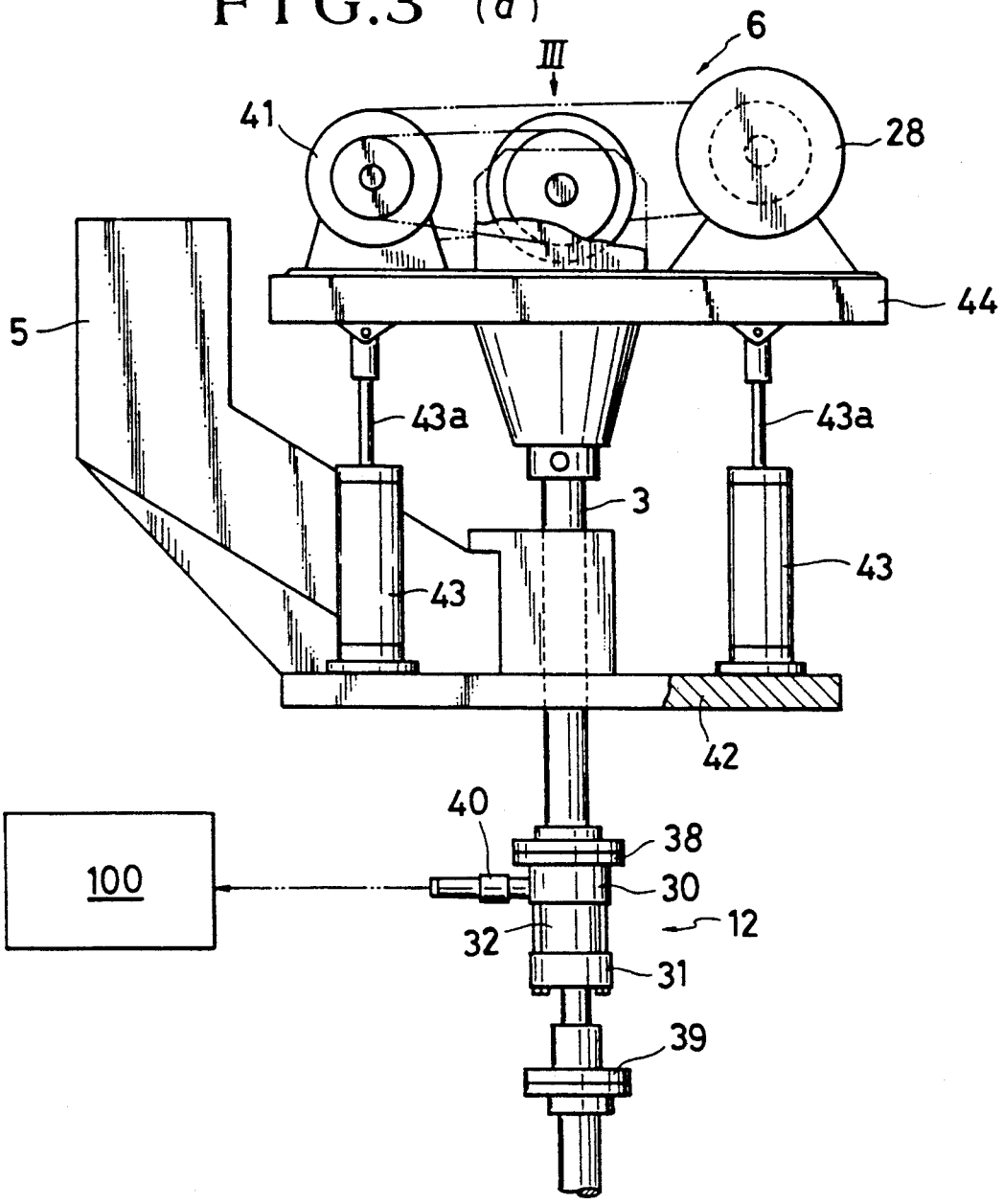
FIG. 3(*a*) is a partially sectional side view showing the whole structure of an upper portion of a compaction rod including a compaction rod reaction detecting device and a compaction rod drive device, and FIG. 3(*b*) is a view taken on line III of FIG. 3(*a*)
Figure 3:
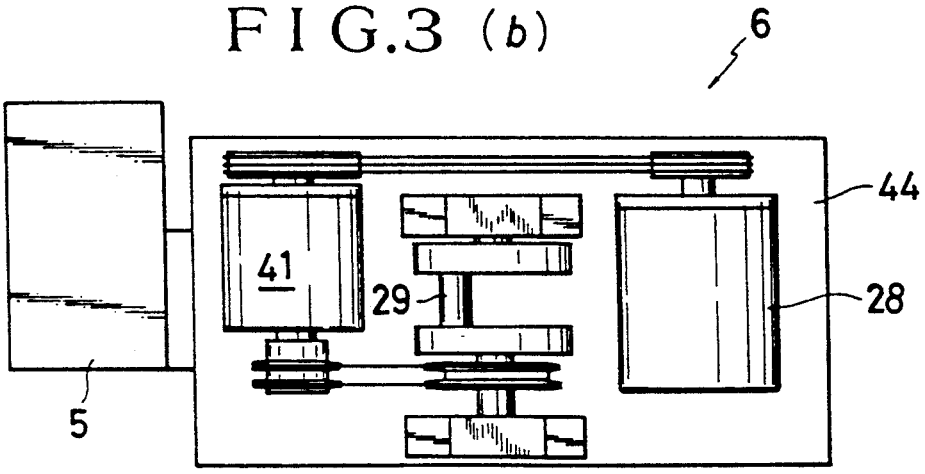
Figure 4:
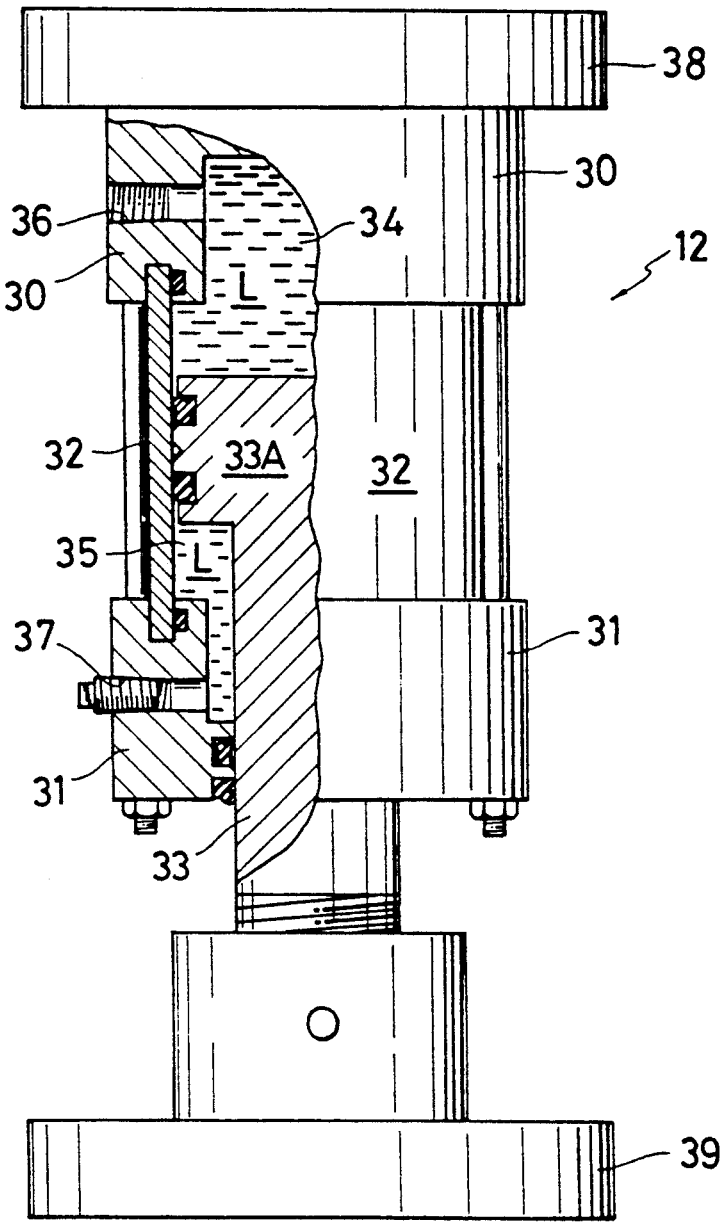
FIG. 4 is a view showing an internal construction of the compaction rod detecting device.
Figure 5:
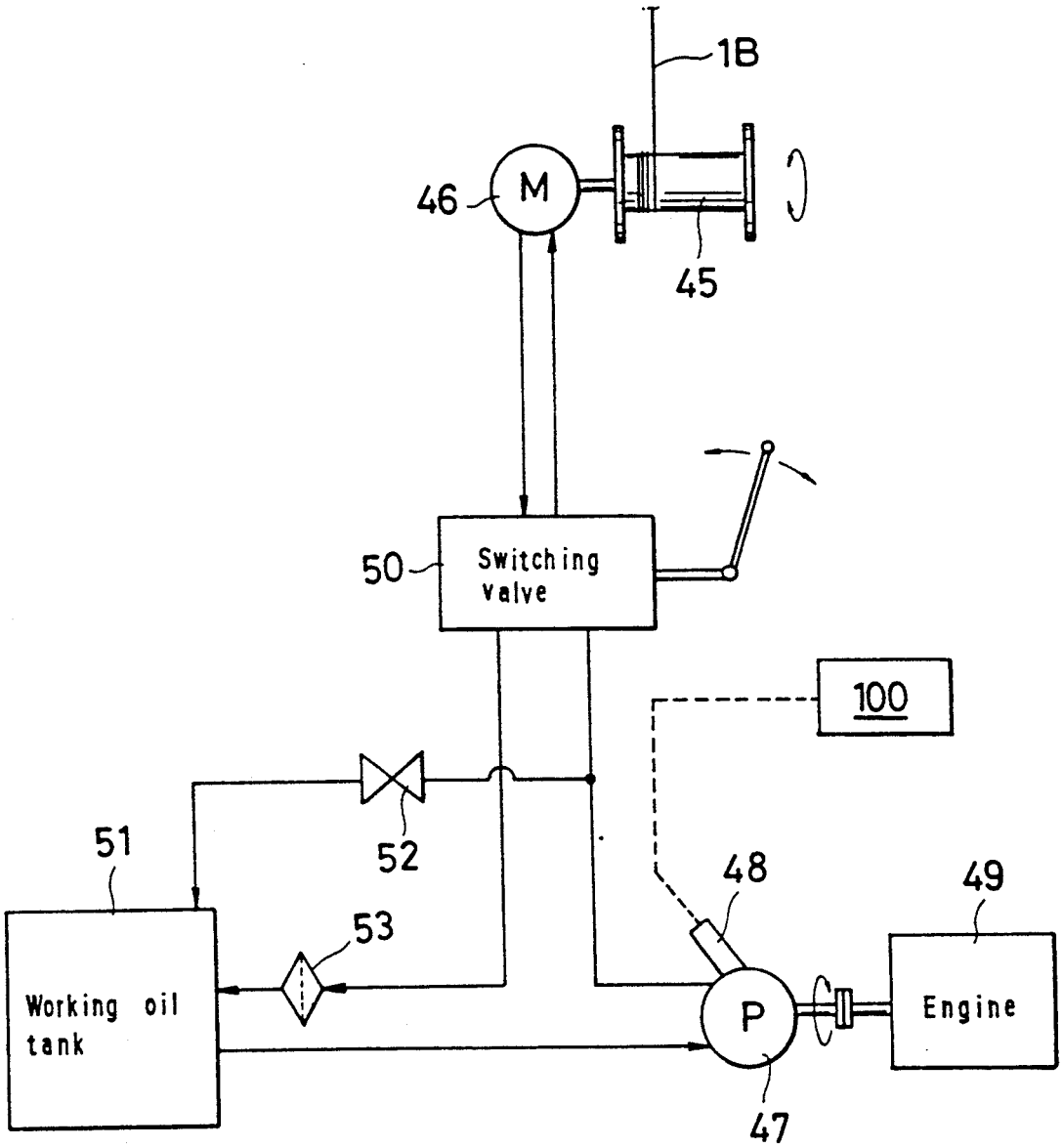
FIG. 5 is a hydraulic circuit of a casing raising device.
Figure 6:
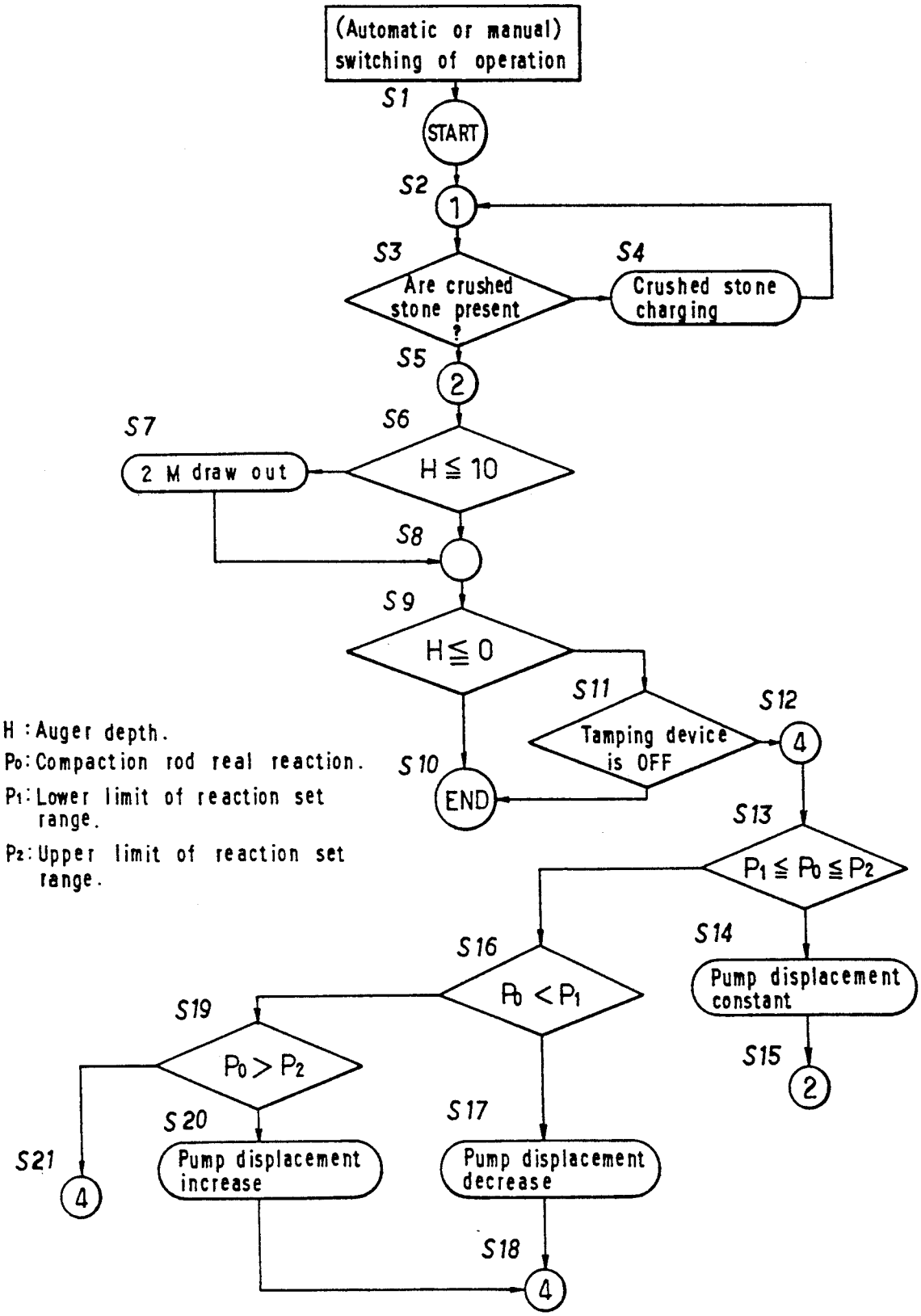
FIG. 6 is a flow chart.

FIG. 1 to FIG. 6 show one embodiment of the present invention. That is, FIG. 1 shows a schematic structure of the whole apparatus for embodying the present invention; FIG. 2 schematically shows the structure of essential parts thereof; FIG. 3 to FIG. 5 show partial constructions of various parts; and FIG. 6 is a flow chart of the method according to the present invention.

In FIG. 1, reference character E designates a sand layer as the object for improvement in ground according to the present invention, which sand is loosely compacted and level of ground water is high. Gravel drain piles P composed of aggregates S for driving a gravel drain pile such as crushed stones, salg, gravel, cobbles, etc. are placed into the sand layer E at suitable spacings.

An apparatus for driving a gravel drain pile K according to the present embodiment has the function of automatically driving the gravel drain pile while compacting the peripheral ground at a predetermined tamping degree. The apparatus K comprises a pile hammer body 1 having a vertically erected leader 1A and a wire 1B suspended along the leader 1A and which can be wound and unwound by a winch; a hollow casing 2 guided along the leader 1A; a compaction rod 3 disposed to be projected from the lower end of the upper end along the center axis within the casing 2; a pile hammering upper device 7 comprising a casing rotatively drive device 4, a crushed stone charging hopper 5 and a compaction rod drive device 6 fixedly mounted on the upper end of the casing to be rotatable through or not through a frame, said upper end being connected to said wire 1B (which elements constitute a so-called actuator section); detection devices disposed on said elements; a work instruction device; and a processor 100 for processing signals outputted from said detection devices in accordance with a predetermined program (which elements constitute a so-called control section).

The apparatus K is further provided with an equipment operation and control section 101 and a display section 102.

As shown in FIG. 1, a crushed stone charging signal and a crushed stone top end signal are detected from the crushed stone charging hopper 5 portion, a compaction rod reaction signal is detected from the compaction rod drive device 6, and the casing depth signal is detected from a casing 2 portion.

Construction of the aforesaid elements will be described hereinafter.

The pile hammer body 1 can be moved by a crawler 1C. The casing 2 has a spiral blade 2A provided in the outer periphery thereof and an open- and closable lid 2B provided at the lower end thereof.

FIG. 2 schematically shows the relative structure between the actuator section and the control section. The detection section of the control section will be first described.

The detection section is provided with a casing depth detection device 10, a crushed stone top end detection device 11 and a compaction rod reaction detection device 12.

The casing depth detection device 10 is secured to the casing 2. A cable 15 which is moved as the casing 2 moves up and down is passed over between an upper sheave 16 and a lower sheave 17, and a rotary shaft 18 of the upper sheave 16 is operatively connected to a rotary encoder 19. With this arrangement, as the casing 2 moves up and down, the cable 15 causes the upper sheave 16 to rotate, and the encoder 19 operatively connected thereto detects rotation of the upper sheave 16 and depth of the casing 2.

The crushed stone top end detection device 11 is designed so that a cable 22 having a weight 21 secured to the lower end thereof is wound on a winch 24 driven by a motor 23, and a rotary encoder 26 is operatively connected to a rotary shaft 25 of the winch 24.

The compaction rod reaction detection device 12 is disposed above the compaction rod 3. More specifically, the compaction rod 3 has its upper end coupled to a crank shaft 29 rotatively driven by an electric drive motor 28 constituting the compaction rod drive device 6 through a pin and connecting rod mechanism. The detection device 12 is disposed in the vicinity of the crank shaft 29.

FIG. 3 and FIG. 4 show the detailed construction of the compaction rod reaction detection device 12. That is, FIG. 3 shows the whole upper portion of the compaction rod including the compaction rod detection device 12 and the compaction rod drive device 6, and FIG. 4 shows the internal construction of the compaction rod reaction detection device 12.

As shown in FIG. 4, in the compaction rod reaction detection device 12, a cylinder wall 32 between upper and lower cylinder bodies 30 and 31 is interiorly formed with a liquid-tight cylindrical space, into which is fixed a piston 33 having a piston head 33A. The cylindrical space is divided into upper and lower chambers 34 and 35 by the piston head 33A, each of said chambers being filled with a non-compressive liquid (normally, mineral oil) L. The cylinder bodies 30 and 31 are bored with mounting ports 36 and 37, respectively, in communication with the upper and lower chambers 34 and 35. The compaction rod 3 is removably mounted through upper and lower flanges 38 and 39.

In the present embodiment, a pressure detection sensor shown in FIG. 4 is mounted on the upper chamber 34 in a pressure conductive manner through the mounting port 36. The pressure sensor 40 is of the load cell type, for example, detection signal of which is transmitted to the processor 100. The mounting port 37 of the lower chamber 35 is closed by a blind lid, and the pressure detection sensor is not provided.

As shown in FIG. 3, in the compaction rod drive device 6, rotation of the motor 28 is suitably reduced through a pulley and belt transmission device and a reduction gear 41 and then transmitted to the crank shaft 29. The compaction rod drive device 6 is placed on the frame 42 and is supported as a whole through a floor plate 44 on a piston rod 43*a* of a hydraulic cylinder 43 constituting a height adjusting mechanism.

Turning back to FIG. 2, the processor 100 receives a tamping device operation signal and a compaction rod reaction range set value. The tamping device operation signal is inputted as a work instruction signal by an operating panel within an operation chamber of the pile hammer body 1A. The compaction rod reaction range set value is likewise inputted from the operating panel of the operation chamber.

On the other hand, in the actuator section controlled by the aforementioned control section, the casing raising device 8 including the compaction rod drive device 6 and the winch mounted on the pile hammer body 1 is selected in the present embodiment.

The compaction rod drive device 6 sends its operation signal to the processor 100. The device receives a period signal from the processor 100 to vary the rotational speed of the drive motor 28 to vary the period of the compaction rod, which will be described later. In the present embodiment, the compaction rod drive device 6 is installed through the floor plate 44 on the hydraulic cylinder 43 constituting the height adjusting mechanism, but the device 6 is directly installed on the frame 42 in the case where a height adjusting mechanism is not provided.

The casing raising device 8 includes a winch 45 mounted on the pile hammer body 1, a hydraulic motor 46 for driving the winch 45 and a variable capacity type hydraulic pump 47 driven by the engine for driving the hydraulic motor 46. The hydraulic pump 47 receives a signal from the processor 100 through a regulator 48 located at the hydraulic pump to vary a displacement to control the rotational speed of the hydraulic motor 46 to thereby adjust the raising speed of the casing 2 connected to the wire 1B wound on the winch 45.

FIG. 5 shows one example of a hydraulic system of a hydraulically driven pile hammer. That is, according to this pile hammer, pressure oil is supplied to the hydraulic motor 46 through a switching valve 50 by the hydraulic pump 47 driven by the engine 49 and returned to a tank 51.

Reference numeral 52 designates a relief valve, and 53 denotes a filter 53.

The gravel drain pile is driven in accordance with the flow chart shown in FIG. 6 using the gravel drain pile driving apparatus comprising the actuator section and the control section as described above.

The operation of the present driving apparatus, that is, the procedure of the method for driving a gravel drain pile will be described hereinafter.

When an operation button is automatically switched, step 1 starts, and step 2 is shifted to step 3. In step 3, charging of crushed stones is determined, and if the crushed stones are not present, the stones are charged. The step is returned to step 2, and step 3 is again carried out. The determination of charging of the crushed stones is in accordance with the signal from the aforementioned crushed stone charging detection device 11.

In the case where the crushed stones are present in the determination by step 3, step 5 is shifted to step 6. In step 6, depth of the casing is determined. In the case where the maximum set depth is 10 m, if the depth exceeds 10 m, the casing is pulled out by 2 m in step 7, and step 7 is shifted to step 8. The determination of the depth of the casing is in accordance with the signal from the aforementioned casing depth detection device 10.

In the case where the depth of the casing is less than 10 m, step 8 is shifted to step 9. In step 9, determination is made if the depth of the casing is less than 0 m. If the depth is less than 0 m, step 9 is shifted to step 10, where raising of the casing is stopped. In the case where the depth of the casing exceeds 0 m, step 10 is shifted to step 11, where determination is made if the tamping device is off. In case of off, raising of the casing is stopped in step 10. The on and off of the tamping device means a work instruction. If the work instruction is off, the apparatus immediately stops.

In the case where the tamping device is not off, step 12 is shifted to step 13. In step 13, determination is made if a real reaction Po of the compation rod is between a lower limit $P_1$ and an upper limit $P_2$ of reaction set value. If it is within a predetermined range, step 13 is shifted to step 14 where the displacement of the pump is made constant through the regulator to make the raising speed of the casing constant. Step 15 is shifted to step 5.

If the real reaction of the compaction rod is not within the predetermined range, determination is first made in step 16 if the real reaction is smaller than the lower limit value. If the real reaction is smaller than the lower limit value, the displacement of the pump is reduced through the regulator in step 17 to reduce the raising speed of the casing. Step 18 is returned to step 12.

If the real reaction is larger than the lower limit value, determination is made in step 19 if the real reaction is larger than the upper limit value. If the real reaction is larger than the upper limit value, the displacement of the pump is increased in step 20 to increase the raising speed of the casing. Step 18 is returned to step 12. If the real reaction is smaller than the upper limit value, step 21 is returned to step 12.

In this manner, in the present embodiment, the actuator section is operated in accordance with a program provided in the processor 100 in response to a detection value detected by each of the detection portions, whereby the gravel drain pile is automatically driven.

If set values of the lower limit value $P_1$ and upper limit value $P_2$ are inputted so that the compaction of the ground may be achieved, the ground improving method by the gravel drain piles is carried out. In the case where only the drain effect of the gravel drain pile is expected, the upper and lower limit values may be set to be smaller.

According to the case where the ground improvement by the gravel drain piles is expected, the grain size of crushed stones according to the soil of the subject ground, and reaction enough to compact the peripheral ground for the drain piles calculated from the soil and the grain size of crushed stones is provided as a set value.

The compaction rod tamps the crushed stones in exact quantities in response to the set value, and therefore, the ground having a predetermined compacting degree is obtained without disconnection of drain piles.

According to the present invention, properties of the ground are detected at real time with the reaction value of the compaction rod during the driving of gravel drain piles, and the ground is improved at a predetermined compacting degree in response to the detected value. Thus, the efficiency of execution may be enhanced without occurrence of incomplete execution.

According to the embodiment of a method for driving a single drain pile, a set reaction value is set to a degree not to loosen the strength of the peripheral ground, whereby drain piles having a constant and homogeneous compacting degree are driven.

In the driving method according to the aforementioned embodiment, the raising of 2 m after confirmation of charging of crushed stones in the initial step is shown as an example, and a suitable value from 0.5 to 2.5 m adjusted to the soil is employed every time. In case of an electric winding device in place of a hydraulic control mechanism of a varying mechanism of the raising driving device, a speed adjusting device such as an inverter is disposed between an electric motor (in this case, an induction motor is preferably used) for driving the winch and a power source to supply a signal to the speed control device to variably control the speed of the motor.

Other Embodiments

While in the aforementioned embodiment, determination factors such as the period and amplitude of the compaction rod and the height of the extreme end thereof other than the compacting degree as the casing is raised have been constant, it is to be noted that the following mode in which these factors in addition to the raising speed of the casing are made variable may be employed.

First, in the mode wherein the raising speed of the casing is made constant and the period of the compaction rod is made variable, the rotational speed of the electric motor 28 of the compaction rod driving device 6 is suitably increased or decreased by the signal from the processor 100. In this case, as the electric motor 28, an inverter type motor is employed, rotational frequency of which can be varied to easily control the speed. In a normal electric motor, a method may be employed in which the speed is controlled by employment of a stepless speed change gear which is electromagnetically driven.

In the aforesaid mode, when the detected reaction value of the compaction rod is small, judgement is made that the tamping degree is small, and the rotational speed of the driving motor 28 is increased and the period of the compaction rod is decreased. When the detected reaction value is large, judgement is made that the tamping degree is large, and the rotational speed of the driving motor 28 is decreased and the period of the compaction rod is increased. In this way, a predetermined compacting degree is maintained.

In the mode wherein the raising speed of the casing is made constant and the height of the extreme end of the compaction rod is varied, this may be accomplished by extending and contracting the piston rod 43*a* of the hydraulic cylinder 43 constituting a height adjusting mechanism in response to a signal from the processor 100.

More specifically, the signal from the processor 100 is provided by moving a spool of an electromagnetic direction switching valve (not shown) disposed in a hydraulic circuit for supplying pressure oil to the hydraulic cylinder 43 to thereby suitably switch the pressure oil to the hydraulic cylinder 43.

In the aforesaid mode, in the case where judgement is made that the tamping degree need to be further increased or need to be harder, the hydraulic cylinder 43 is contracted, the compaction rod driving device 6 is lowered, and the extreme end surface of the compaction rod 3 is projected from the lower surface of the casing 2. On the other hand, in the case where the tamping degree is decreased or loosened, the hydraulic cylinder 43 is extended, and the compaction rod driving device 6 is raised, and the extreme end surface of the compacted rod 3 is raised from the lower surface of the casing 2.

Figure 7:
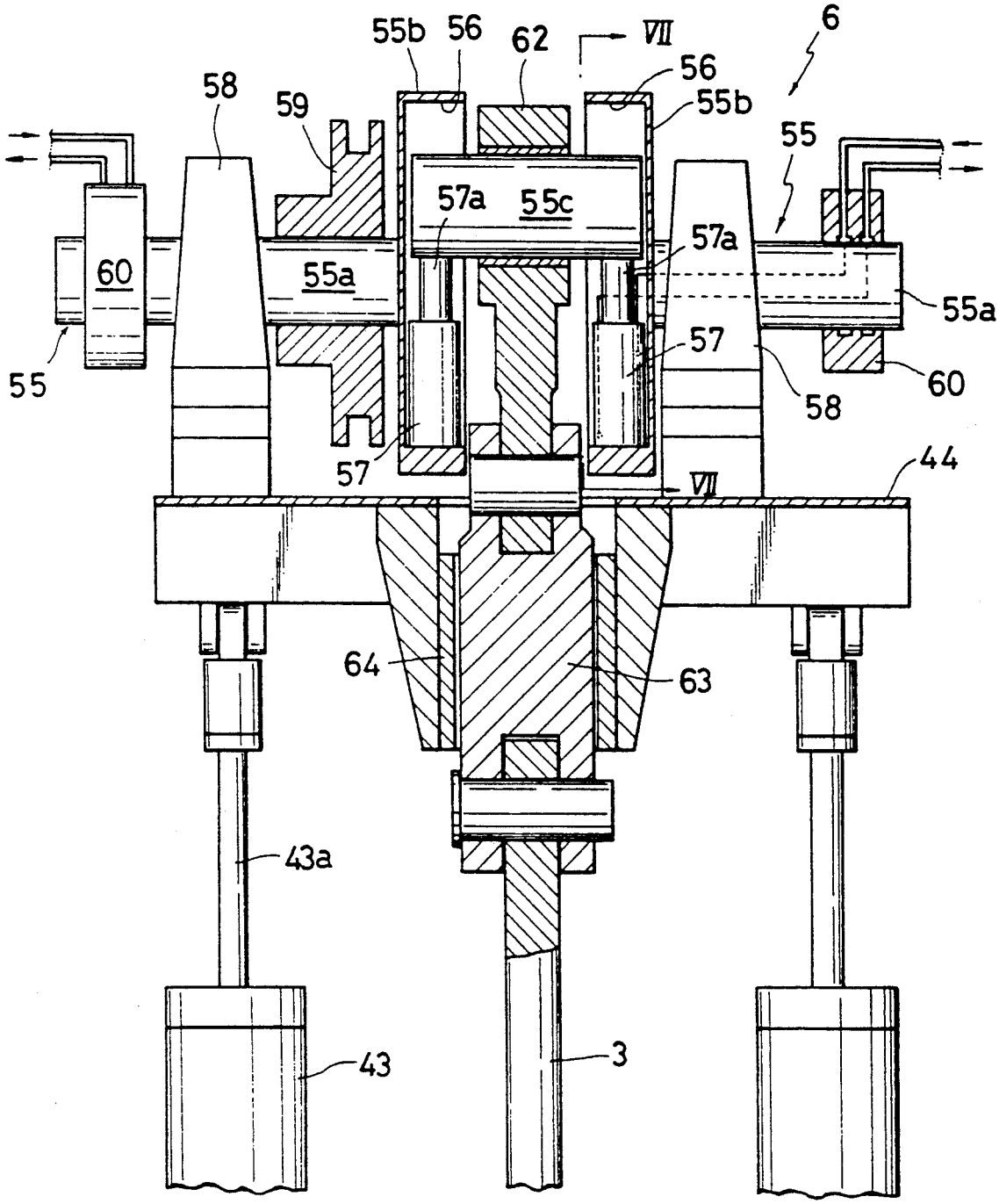
FIG. 7(*a*) is a construction view showing one example of a mechanism for varying an amplitude of a compaction rod, and FIG. 7(*b*) is a sectional view taken on line VII—VII of FIG. 7(*a*).
Figure 7:
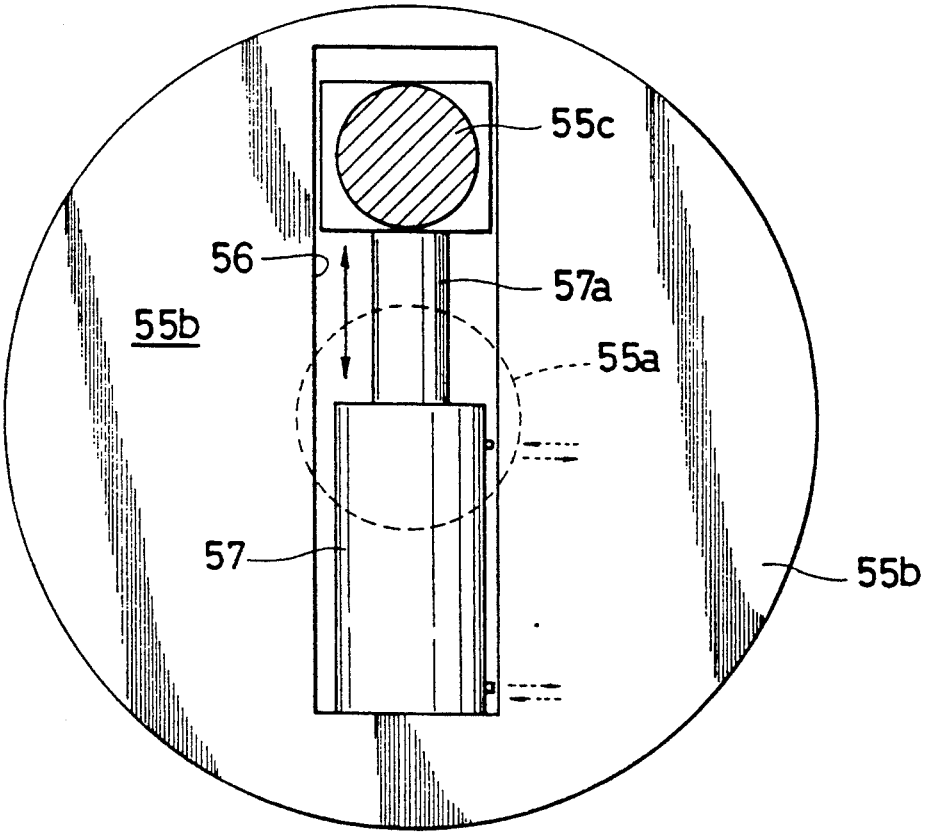

In the mode wherein the raising speed of the casing is made constant and the amplitude of the compaction rod is made variable, a detailed example of a mechanism thereof is shown in FIG. 7.

This mechanism is incorporated in the compaction rod driving device 6, in which a crank shaft 55 of the mechanism includes a crank journal 55*a*, a disc-like crank arm disc 55*b* and a crank pin 55*c* and further a hydraulic cylinder 57 disposed within a recess 56 formed in the surface opposed to the crank arm disk 55*b*. The hydraulic cylinder 57 has its base fixedly mounted on the crank arm disc 55*b*, and a crank pin 55*c* is fixedly mounted on the extreme end of a piston rod 57*a* so that a shaft-center distance of the crank pin 55*c* is varied by movement of the piston rod 57*a*. The crank journal 55*a* has both sides thereof rotatably supported by means of a bearing 58 and a turning force is obtained by a pulley 59. The crank journal 55*a* is interiorly formed with two oil paths (indicated at broken lines) for feeding pressure oil to the hydraulic cylinder 57, and movement of pressure oil into and out of outside is effected by rotary joints 60 provided on opposite sides of the journal 55*a*. The oil paths formed in the journal 55*a* lead to the recess 56 of the crank arm disc 55*b* and are placed in communication with two oil chambers of the hydraulic cylinder 57 as piping in said recess.

A connecting rod 62 is rotatably connected to the crank pin 55*c* through bearing metal, and a piston 63 has its upper and lower ends connected between the connecting rod 62 and the compaction rod 3 by means of pin connections. A cylindrical bearing 64 is disposed externally of the piston 63 to guide upward and downward movement of the piston 63.

In this mechanism, though not shown, an electromagnetic direction switching valve is disposed in a hydraulic circuit for supplying pressure oil to the hydraulic cylinder 57. The signal from the processor 100 causes a spool of the direction switching valve to be moved to normal, reversal and neutral position whereby a flow of pressure oil to the hydraulic cylinder 57 may be suitably switched.

In the aforementioned mode, in the case where judgement is made that the tamping degree need to be further increased, pressure oil is supplied to the hydraulic cylinder 57 so that the piston rod 57*a* may be extended by the signal from the processor 100. Thereby, the shaft-center distance of the crank pin 55*c* increases to increase the eccentric distance of the connecting rod 62 and increase the amplitude of the compaction rod 3. In the case where the tamping degree is decreased, pressure oil is supplied to the hydraulic cylinder 57 so that the piston rod 57*a* may be contracted by the siganl from the processor 100. Thereby, the shaftcenter distance of the crank pin 55*c* decreases to decrease the amplitude of the compaction rod 3.

While in the aforementioned modes, only one element is made variable and others are made constant, it is to be noted needless to say that a plurality of elements may be made simultaneously variable and controlled.

That is, mechanisms for rendering these elements simultaneously variable are combined and some of predetermined target values are selected for control so that the predetermined target values may be achieved in the most adequate manner by the instructions from the processor 100.

What is claimed is:

1. An apparatus for driving gravel drain piles comprising: a casing raising device for raising a hollow casing which is vertically movably guided along a leader and varying a raising speed of said casing; a compaction rod driving device for vertically moving a compaction rod disposed within said casing; a compaction rod reaction detection device disposed halfway of said compaction rod to detect a reaction of the compaction rod and provide a value indicative thereof; a crushed-stone top end detection device for detecting a depth of crushed stones charged into said casing; a casing depth detection device for detecting a depth of interpenetration of said casing; and processing means for comparing, after said casing has reached said predetermined depth and the charging of the crushed stone has been confirmed, the detected value from said compaction rod reaction detection device with a set reaction value and controlling a raising speed of the casing through said casing raising device so as to increase, reduce or make constant the raising speed of the casing and determining a compacting degree of peripheral ground based on said compared value, said processing means being also responsive to said crushed-stone top end detection device and the casing depth detection device.

2. An apparatus for driving gravel drain piles comprising: a casing raising device for raising a hollow casing which is vertically movably guided along a leader; a compaction rod driving device for vertically moving a compaction rod disposed within said casing and varying a period of upward and downward movement of said compaction rod; a compaction rod reaction detection device disposed halfway of said compaction rod to detect a reaction of the compaction rod and provide a value indicative thereof; a crushed-stone top end detection device for detecting a depth of a top end of crushed stones charged into said casing; a casing depth detection device for detecting an interpenetration depth of said casing; and processing means for comparing, after said casing has reached said predetermined depth and the charging of the crushed-stones has been confirmed, the detected value from said compaction rod reaction detection device with a set reaction value and determining a compacting degree of peripheral ground based-on said compared value, wherein said processing means is responsive to said crushed-stone top end detection device and a period of the compaction rod is controlled through the compaction rod driving device.

3. An apparatus for driving gravel drain piles comprising: a casing raising device for raising a hollow casing which is vertically movably guided along a leader; a compaction rod drive device for vertically moving a compaction rod disposed within said casing and varying an amplitude of upward and downward movement of said compaction rod; a compaction rod reaction detection device disposed halfway of said compaction rod to detect a reaction of the compaction rod and provide a value indicative thereof; a crushed-stone top end detection device for detecting a depth of a top end of crushed stones charged into said casing; a casing depth detection device for detecting an interpenetration depth of said casing; and processing means for comparing, after said casing has reached said predetermined depth and the charging of the crushed-stones has been confirmed, the detected value from said compaction rod reaction detection device with a set reaction value and determining a compacting degree of peripheral ground based on said compared value, wherein said processing means is responsive to said crushed-stone top end detection device and an amplitude of the compaction rod is controlled through said compaction rod driving device.

4. An apparatus for driving gravel drain piles comprising: a casing raising device for raising a hollow casing which is vertically movably guided along a leader; a compaction rod driving device for vertically moving a compaction rod disposed within said casing; a compaction rod height adjusting device for vertically moving said compaction rod driving device to vary a position of movement of the compaction rod into said hollow casing; a compaction rod reaction detection device disposed halfway of said compaction rod to detect a reaction of said compaction rod and provide a value indicative thereof; a crushed-stone top end detection device for detecting a depth of a top end of crushed stones charged into said casing; a casing depth detection device for detecting an interpenetration depth of said casing; and processing means for comparing, after the charging of the crushed stones has been confirmed, the detected value from said compaction rod reaction detection device with a set reaction value and determining a compacting degree of peripheral ground based on said compared value, wherein a height of an extreme end surface of the compaction rod is controlled through said compaction rod height adjusting device.

5. An apparatus for driving gravel drain piles comprising: a casing raising device for raising a hollow casing which is vertically movably guided along a leader and varying a raising speed of said casing; a compaction rod driving device for vertically moving a compaction rod disposed within said casing and varying a period of upward and downward movement and an amplitude of said compaction rod; a rod height adjusting device for vertically movably supporting said compaction rod drive device to vary a position of movement of said compaction rod into said hollow casing; a compaction rod reaction detection device disposed halfway of said compaction rod to detect a reaction of said compaction rod and provide a value indicative thereof; a crushed-stone top end detection device for detecting a depth of a top end of crushed stones charged into said casing; a casing depth detection device for detecting an interpenetration depth of said casing; and processing means for comparing, after said casing has reached said predetermined depth and the charging of said crushed-stones has been confirmed, the detected value from said compaction rod reaction detection device with a set reaction value and determining a compacting degree of peripheral ground based on said compared value, wherein said processing means is responsive to said crushed-stone top end detection device and said casing depth detection device and at least one of a raising speed of the casing, a period of the compaction rod, an amplitude of the compaction rod and a height of an extreme end surface of the compaction rod are controlled through said casing raising device, said compaction rod driving device and said compaction rod height adjusting device.

6. A method for automatically driving gravel drain piles comprising the steps of:

interpenetrating a hollow casing to a predetermined depth into a relatively loose sand layer saturated with water;

raising the casing while tamping crushed-stones charged into said casing by a compaction rod disposed within said casing;

driving gravel drain piles at regular intervals within the sand layer while continuously performing the steps of raising the casing and tamping the crushed-stones by the compaction rod;

detecting a magnitude of a crushed-stone tamping reaction by a reaction detecting device provided on said compaction rod and providing a real reaction value;

comparing the real reaction value with a set reaction value which is set in correspondence to the condition of the ground;

controlling a raising speed of the casing in response to said compared value so as to increase, decrease or make constant the raising speed of the casing;

determining a compacting degree of peripheral ground based on said compared value; and compacting the peripheral ground.

7. The method for automatically driving gravel drain piles according to claim 6, further comprising the step of controlling a period of the compaction rod.

8. The method for automatically driving gravel drain piles according to claim 6, further comprising the step of controlling an amplitude of the compaction rod.

9. The method for automatically driving gravel drain piles according to claim 6, further comprising the step of controlling a height of an extreme surface of the compaction rod.

10. A method for automatically driving gravel drain piles comprising the steps of:

interpentrating a hollow casing into a predetermined depth into a relatively loose sand layer saturated with ground water;

raising the casing while tamping crushed stones charged into said casing by a compaction rod disposed within said casing;

driving gravel drain piles at regular intervals within the sand layer while continuously performing the steps of raising the casing and tamping the crushed-stone by the compaction rod;

detecting a magnitude to a crushed-stone tamping reaction by a reaction detecting device provided on the compaction rod and providing a real reaction value;

comparing the real reaction value with a set reaction value which is set in correspondence to the condition of the ground;

controlling at least one of a raising speed of the casing, a period of the compaction rod, an amplitude of the compaction rod and a height of an extreme end surface of the compaction rod in response to said compared value;

determining a compacting degree of peripheral ground based on said compared value; and compacting the peripheral ground.

* * * * *